US009925110B1

(12) United States Patent
Lang et al.

(10) Patent No.: US 9,925,110 B1
(45) Date of Patent: Mar. 27, 2018

(54) SOFT TISSUE MASSAGE TOOLS

(75) Inventors: Gary Lee Lang, Tracy, CA (US); Kevin R. Murray, Los Gatos, CA (US)

(73) Assignee: TECNICA GAVILAN, LLC, Tracy, CA (US)

( * ) Notice: Subject to any disclaimer, the term of this patent is extended or adjusted under 35 U.S.C. 154(b) by 262 days.

(21) Appl. No.: 12/826,867

(22) Filed: Jun. 30, 2010

Related U.S. Application Data

(60) Provisional application No. 61/254,944, filed on Oct. 26, 2009.

(51) Int. Cl.
*A61H 7/00* (2006.01)

(52) U.S. Cl.
CPC ..... *A61H 7/003* (2013.01); *A61H 7/00* (2013.01); *A61H 7/002* (2013.01)

(58) Field of Classification Search
CPC ..... A61H 7/00; A61H 7/002; A61H 7/003; A61H 7/007; A61H 2007/009; A61H 2207/00; A61H 39/04
USPC ..... 601/1, 134–139; 473/590; D21/437; D24/214; 606/204
See application file for complete search history.

(56) References Cited

U.S. PATENT DOCUMENTS

| | | | | | |
|---|---|---|---|---|---|
| 2,806,470 | A | | 9/1957 | Ferrier | |
| 4,343,265 | A | * | 8/1982 | Belschner | 119/633 |
| 4,364,142 | A | * | 12/1982 | Pangle | 15/117 |
| 4,483,328 | A | * | 11/1984 | Wolocko | 601/135 |
| 4,590,926 | A | * | 5/1986 | Courtin | 601/137 |
| 5,231,977 | A | | 8/1993 | Graston | |
| 5,366,437 | A | | 11/1994 | Graston | |
| 5,441,478 | A | | 8/1995 | Graston | |
| 5,707,346 | A | | 1/1998 | Graston | |
| 5,863,251 | A | * | 1/1999 | Fusco | 463/47.2 |
| 6,077,239 | A | | 6/2000 | Lin | |
| 6,126,620 | A | | 10/2000 | Graston | |
| D524,445 | S | * | 7/2006 | Liang | D24/214 |
| 2001/0051778 | A1 | * | 12/2001 | Sevier | A61H 7/001 601/137 |
| 2009/0240177 | A1 | * | 9/2009 | Sullivan | A61H 7/003 601/136 |

FOREIGN PATENT DOCUMENTS

| | | | |
|---|---|---|---|
| KR | 30-0321367 | * | 3/2002 |

* cited by examiner

*Primary Examiner* — Michael Tsai
(74) *Attorney, Agent, or Firm* — Middleton Reutlinger; Alexander P. Brackett

(57) ABSTRACT

A plurality of skin-contacting instruments for the manipulation of soft tissue adhesions are disclosed. Each of the instruments comprises a plurality of curvilinear edge surfaces having different radii for contacting the skin in a plurality of locations.

25 Claims, 6 Drawing Sheets

SOFT TISSUE MASSAGE TOOLS

CROSS-REFERENCE TO RELATED DOCUMENTS

This Application claims the benefit of Provisional Application Ser. No. 61/254,944 filed Oct. 26, 2009 and entitled Soft Tissue Massage Tools, which is hereby incorporated by reference in its entirety.

TECHNICAL FIELD

The present invention relates generally to methods and apparatus related to practicing soft tissue massage, including a plurality of tools for engaging the skin of an area to be massaged. The tools provide a plurality of curvilinear surfaces of different radii and have a plurality of beveled treatment edges for contacting skin surfaces, thereby facilitating therapeutic massage for a broad array of differing physiologies.

BACKGROUND

Scar tissue is widely found in soft tissue portions of the human anatomy, such as muscles, tendons, and ligaments. Formation of scar tissue is a natural byproduct of injury and concomitant inflammation of a soft tissue area. Scar tissue often prevents muscles, tendons and ligaments from lengthening and contracting properly, which in turn causes decreased range of motion as well as pain. Furthermore, the build-up over time of scar tissue tends to cause ongoing pain even when the injury no longer exists. Accordingly, there is a need for removal or reduction of scar tissue.

Scar tissue is typically removed by a process called soft tissue therapy, which provides for manual massage of the skin over the soft tissue area affected to release scar tissue adhesions, thereby enhancing length in the soft tissue. Cross-frictional massage, deep muscle massage and rolfing are known types of soft tissue massage. The application of the correct amount of pressure, accurately targeted to the affected area is crucial for the efficient release of scar tissue. However, it is often quite difficult to accurately target scar tissue with the human hand. Additionally, applying the requisite pressure to an affected area may be quite difficult using manual massage. This problem becomes even more pronounced when a therapist is required to treat many patients in a single day, since the muscles in the hands become tired through constant use.

Based on the foregoing, there is a need in the art for an aid to therapists engaging in soft tissue therapy. Prior art devices such as those shown and described in U.S. Pat. No. 5,707,346 to Graston have been used to aid in soft tissue massage. However, many of these prior art devices do not enable a therapist to accurately target a wide variety of soft tissue injuries. While the instruments shown in Graston may be suitable for some soft tissue areas such as the knee, other soft tissue areas may be more amenable to instruments having different contact surfaces. Accordingly, there is a further need for an instrument system that enables a therapist to manipulate a plurality of soft tissue areas with simple but efficient instruments.

SUMMARY

The present disclosure is directed generally toward inventive methods and apparatus related to practicing soft tissue massage. For example, one or more tools for engaging the skin of an area to be massaged may be provided. One or more of the tools may comprise curvilinear surfaces of different radii and may have one or more beveled edges for contacting skin surfaces, thereby facilitating therapeutic massage for a broad array of differing physiologies.

Generally, in one aspect an instrument for the manipulation of soft tissue adhesions includes a skin contacting member having a first side, a second side opposite the first side, and an edge extending along a periphery thereof. The edge has at least one inner curved portion, at least one outer curved portion, and opposed rounded ends that are connected to the inner curved portion and the outer curved portion. A majority of the edge is a treatment edge configured for treatment of soft tissue. The treatment edge has a first bevel and a second bevel along at least a portion thereof. The first bevel extends toward the first side of the contacting member and the second bevel extends toward the second side of the contacting member. At least a portion of the first bevel has at least one of a distinct height and a distinct angle from a corresponding portion of the second bevel. The inner curved portion and the outer curved portion are tapered curve portions with respect to one another In some embodiments the portion of the first bevel has both a distinct height and a distinct angle from the corresponding portion of the second bevel.

In some embodiments an entirety of the edge is the treatment edge. In some versions of these embodiments the first bevel and the second bevel are provided along the entirety of the treatment edge.

In some embodiments at least one of the inner curved portion and the outer curved portion has a variable radius along a length thereof.

In some embodiments the inner curved portion forms part of a first circle having a first radius and the outer curved portion forms part of a second circle having a second radius distinct from the first radius. The first circle has a first circle center point that is offset from a second circle center point of the second circle in at least two axis. In some versions of these embodiments the inner curved portion is concave and the outer curved portion is convex. In some versions of these embodiments the outer curved portion extends along at least the entire length of the inner curved portion.

In some embodiments the instrument further includes a second inner curved portion connected to a single of the rounded ends and the inner curved portion. In some versions of these embodiments the second inner curved portion is concave and the inner curved portion is convex. In some versions of these embodiments the instrument further includes a second outer curved portion connected to a single of the rounded ends and the outer curved portion. In some versions of these embodiments the second outer curved portion is concave and the outer curved portion is convex.

Generally, in another aspect an instrument for the manipulation of soft tissue adhesions includes a skin contacting member having a continuous treatment edge provided along the periphery thereof. The continuous treatment edge is configured for treatment of soft tissue and has at least one inner curved portion, at least one outer curved portion, and opposed ends connected to the inner curved portion and the outer curved portion. The continuous treatment edge also has a first bevel and a second bevel along at least a portion thereof. The first bevel extends toward a first side of the contacting member and the second bevel extends toward a second side of the contacting member.

In some embodiments at least a portion of the first bevel has at least one of a distinct height and a distinct angle from a corresponding portion of the second bevel.

In some embodiments the inner curved portion and the outer curved portion are tapered curve portions with respect to one another.

In some embodiments the first side of the contacting member has a plurality of ridges thereon proximal each of the opposed ends. In some versions of these embodiments the ridges are substantially planar with surrounding portions of the first side. In some versions of these embodiments the second side of the contacting member has a plurality of ridges thereon proximal each of the opposed ends. In some versions of these embodiments the second side of the contacting member has a plurality of ridges thereon substantially across the entirety thereof.

In some embodiments one of the opposed ends has a pick portion. In some embodiments the first bevel at the pick portion has at least one of a distinct height and a distinct angle from the second bevel at the pick portion. In some versions of these embodiments the first bevel at the pick portion has both a distinct height and a distinct angle from the second bevel at the pick portion.

In some embodiments the first bevel and the second bevel are provided along the entirety of the treatment edge.

Generally, in another aspect an instrument for the manipulation of soft tissue adhesions includes a skin contacting member having a first side, a second side opposite the first side, and a treatment edge provided along a majority of the periphery of the skin contacting member. The treatment edge has a plurality of unique contact surfaces therealong. Each of the unique contact surfaces is configured to engage a unique portion of soft tissue. The first side of the contacting member has a plurality of ridges thereon proximal each of the opposed ends. The second side of the contacting member has a plurality of ridges thereon proximal each of the opposed ends. The ridges are arranged to enable contact between at least some of the ridges and fingers of a therapist during engagement of any of the unique contact surfaces against the soft tissue.

Generally, in another aspect, an instrument for the manipulation of soft tissue adhesions includes a skin contacting member having a first side, a second side opposite the first side, and a treatment edge provided along a majority of the periphery of the skin contacting member. The treatment edge has a first bevel and a second bevel along at least a portion thereof. The first bevel extends toward the first side of the contacting member and the second bevel extends toward the second side of the contacting member. Along a first portion of the treatment edge the first bevel and the second bevel have a substantially common first angle. Along a second portion of the treatment edge the first bevel has a second angle offset from the first angle at least ten degrees.

In some embodiments the second angle is offset from the first angle at least twenty degrees.

In some embodiments the second bevel is at least fifty percent of the height of the first bevel along the first portion.

In some versions of these embodiments the second bevel is at least twenty-five percent of the height of the first bevel along the first portion.

In some embodiments along the second portion of the treatment edge the second bevel has the second angle.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

DETAILED DESCRIPTION

Figure 1A:
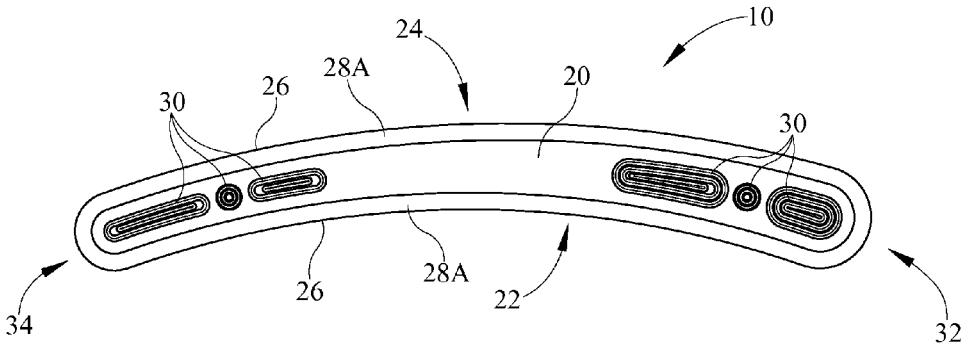
FIG. 1A is a side view of a first side of an instrument for manipulation of soft tissue adhesions in accordance with one embodiment of the present invention.
Figure 1B:
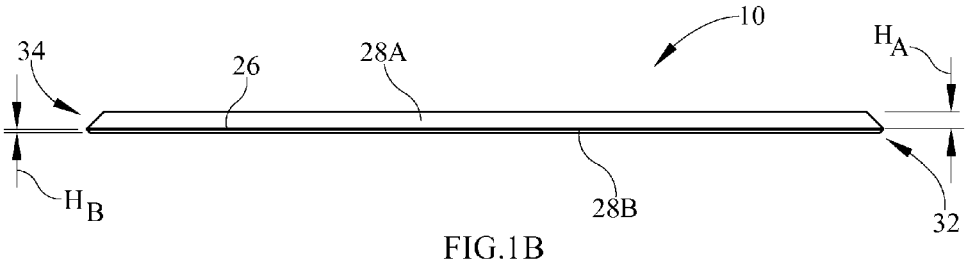
FIG. 1B is a front elevation view of the instrument for manipulation of soft tissue adhesions of FIG. 1A.
Figure 1C:
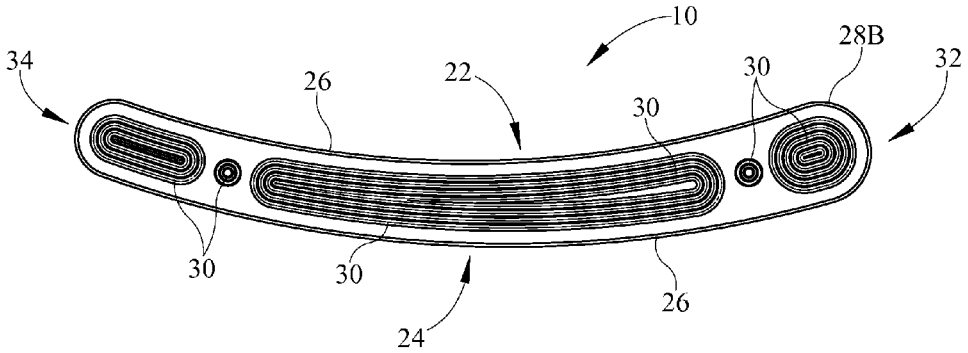
FIG. 1C is a side view of a second side of the instrument for manipulation of soft tissue adhesions of FIG. 1A.
Figure 1D:
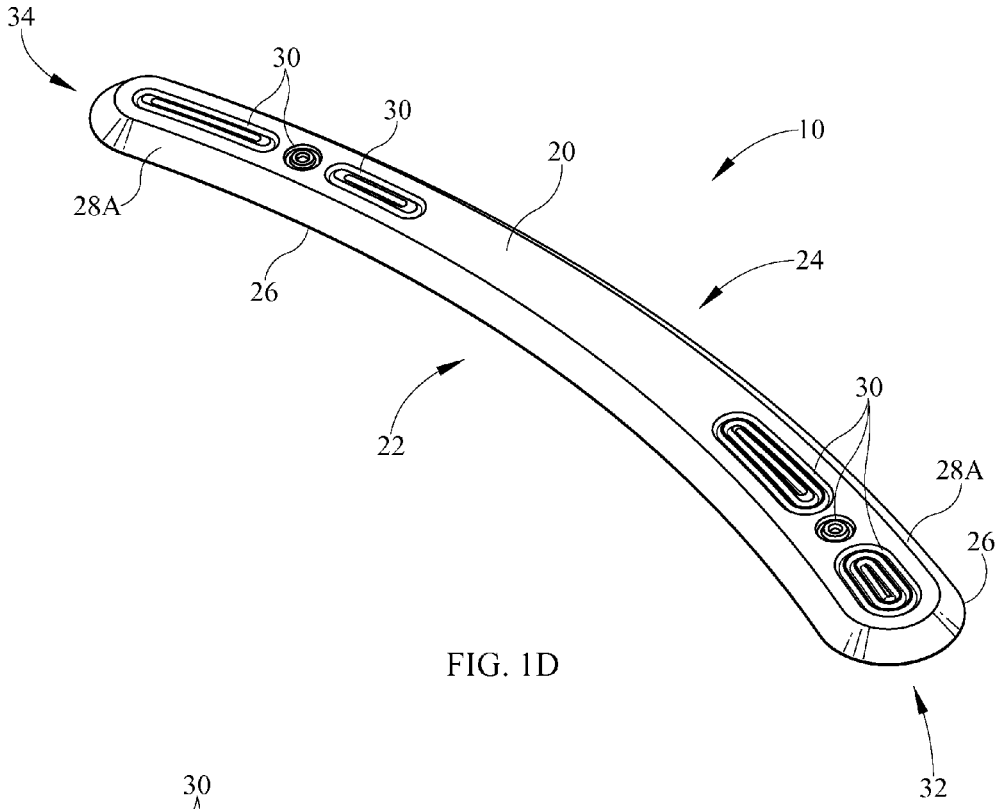
FIG. 1D is a front first side perspective view of the instrument for manipulation of soft tissue adhesions of FIG. 1A.
Figure 1E:
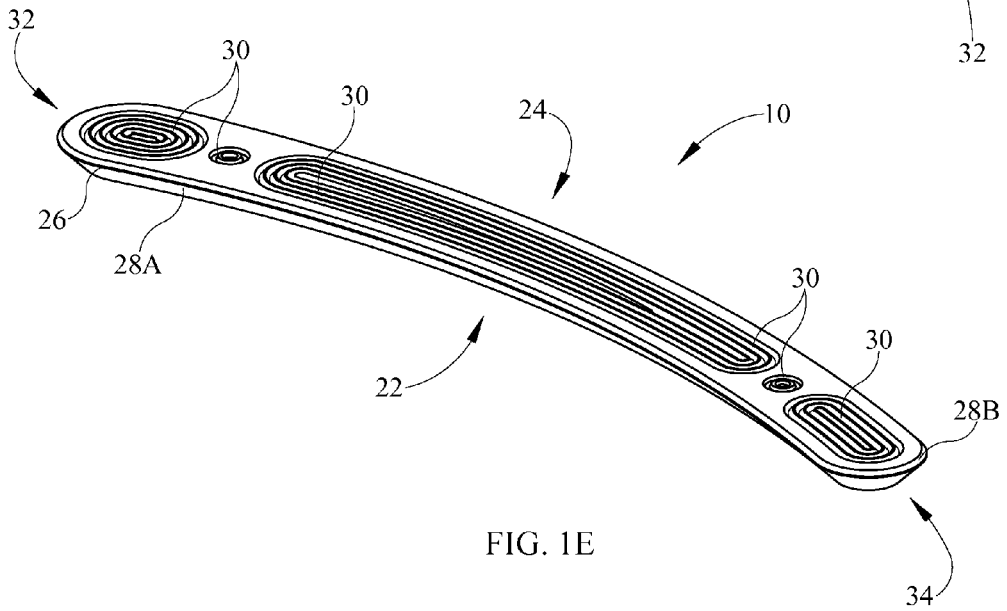
FIG. 1E is a front second side perspective view of the instrument for manipulation of soft tissue adhesions of FIG. 1A.
Figure 2A:
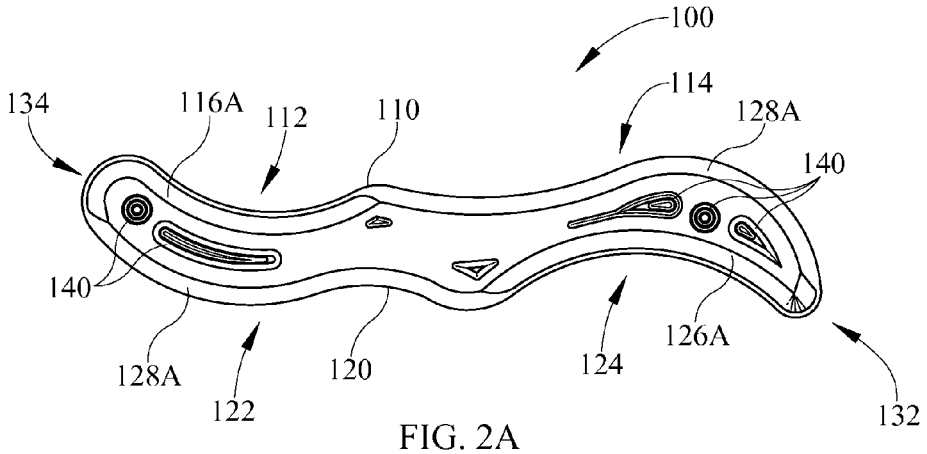
FIG. 2A is a side view of a first side of an instrument for manipulation of soft tissue adhesions in accordance with one embodiment of the present invention.
Figure 2B:
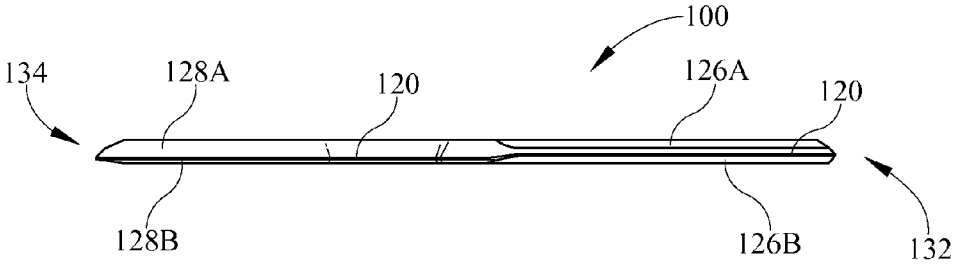
FIG. 2B is an elevation view of the instrument for manipulation of soft tissue adhesions of FIG. 2A.
Figure 2C:
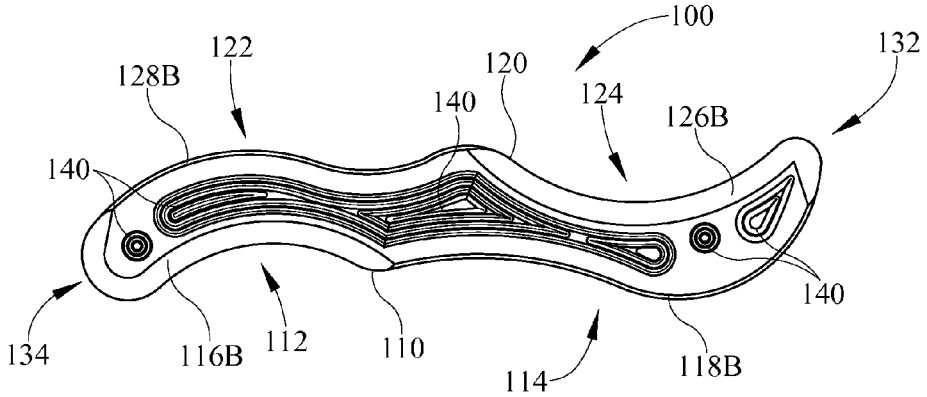
FIG. 2C is a side view of a second side of the instrument for manipulation of soft tissue adhesions of FIG. 2A.
Figure 2D:
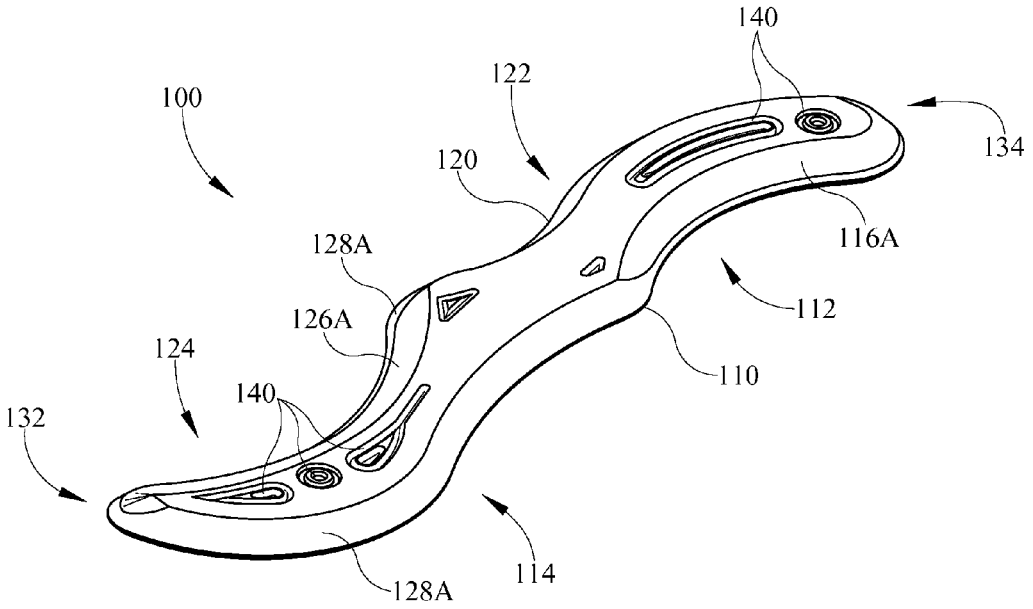
FIG. 2D is a front first side perspective view of the instrument for manipulation of soft tissue adhesions of FIG. 2A.
Figure 2E:
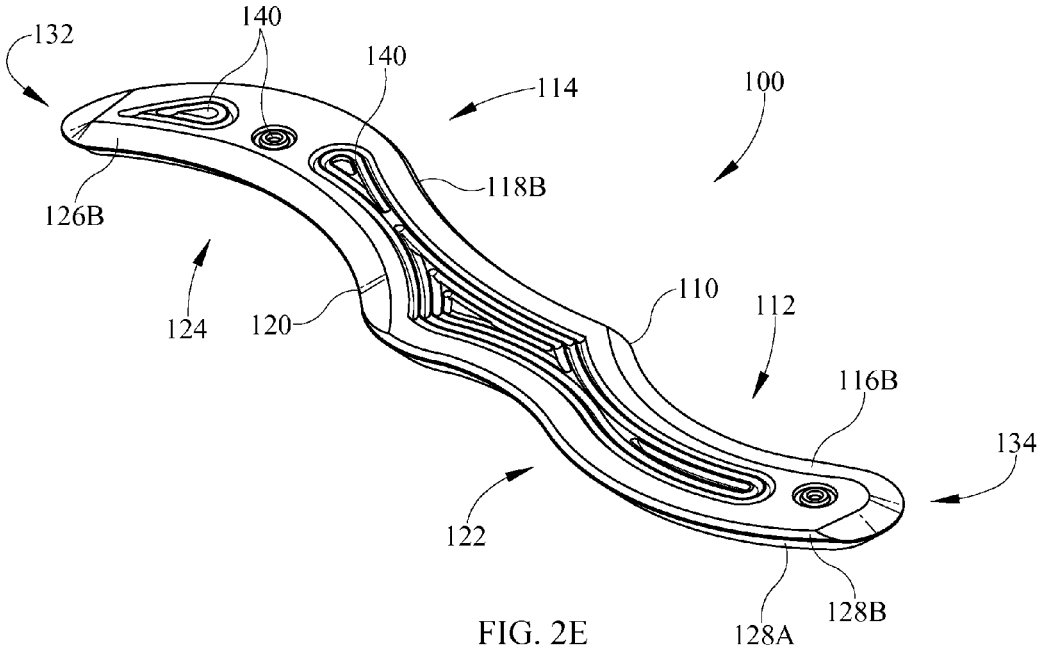
FIG. 2E is a front second side perspective view of the instrument for manipulation of soft tissue adhesions of FIG. 2A.

Referring now to FIGS. 1A-3E, and in accordance with a preferred constructed embodiment of the present invention, a system for soft tissue manipulation includes a first instrument 10, a second instrument 100, and a third instrument 200. As shown in FIGS. 1A-1E, the first instrument 10 for the manipulation of soft tissue adhesions comprises an arcuate or curved member 20 having a curvilinear continuous treatment edge 26 for contacting and treating soft tissue. The edge 26 includes an inner curved (or concave) portion 22 and an outer curved (or convex) portion 24 for contacting and treating soft tissue. The inner curved portion 22 and the outer curved portion 24 are each connected to a first end 32 and a second end 34 of the edge 26. The first end 32 and the second end 34 may comprise a rounded section which may also be employed to contact and treat soft tissue. A flat portion of the edge 26 may optionally be interposed between the inner curved portion 22 and the second end 34. The flat portion may provide a unique contact surface and may also be employed to contact soft tissue.

The inner curved portion 22 and the outer curved portion 24 have different radii with respect to one another. The inner curved portion 22 and the outer curved portion 24 may comprise tapering curves (e.g., curves having decreasing or tapering diameters and/or curves having decreasing or tapering distances with respect to one another). For example, in the depicted embodiment the curvature of the outer curved portion 24 is substantially constant along a length thereof and the curvature of the inner curved portion 22 is substantially constant along a length thereof. The inner curved portion 22 and the outer curved portion 24 form part of non-concentrically aligned circles that have center points that are vertically and horizontally misaligned with one another (as viewed looking at FIG. 1A). Accordingly, the distance between the outer curved portion 24 and the inner curved portion 22 proximal the second end 34 is less than the distance between the two proximal the first end 32. In the depicted embodiment the inner curved portion 22 forms part of a circle having a radius of approximately 11.0125 inches and the outer curved portion 24 forms part of a circle having a radius of approximately 12.9875 inches. This feature of inner curved portion 22 and outer curved portion 24 having decreasing or tapering distances with respect to one another creates an asymmetric first instrument 10 and permits the instrument 10 to be utilized on a greater number of soft tissue areas.

Also, for example, in alternative embodiments the curvature of the inner curved portion 22 and/or the outer curved portion 24 may be variable along lengths thereof to thereby create tapering curves having decreasing or tapering diameters. For example, the curvature of the inner curved portion 22 proximal the first end 32 may be distinct from the curvature of the inner curved portion 22 proximal the second end 34. Also, for example, in some embodiments the curvature of the outer curved portion 24 proximal the middle thereof may be distinct from the curvature of the outer curved portion 24 proximal the first end 32 and/or proximal the second end 34. As an illustrative embodiment, the curvature of the outer curved portion 24 may decrease as it moves from the second end 34 to the first end 32. In other words, the radius of the outer curved portion 24 may be greater proximal the first end 32 than proximal the second end 34. Conversely, the curvature of the inner curved portion 22 may increase as it moves from the second end 34 to the first end 32. Accordingly, in the illustrative embodiment the distance between the outer curved portion 24 and the inner curved portion 22 proximal the second end 34 may be less than the distance between the two proximal the first end 32

The edge 26 extends along the entire periphery of the first instrument 10 and has two forty-five degree bevels 28A and 28B. The height of bevel 28A is substantially greater than the height of bevel 28B in the depicted embodiment. In some embodiments the height of the bevel 28B (denoted by reference character $H_B$ in FIG. 1B) may be approximately fifteen percent of the height of the bevel 28A (denoted by reference character $H_A$ in FIG. 1B). Accordingly, in some embodiments the surface area of the bevel 28A may be substantially greater than the surface area of the bevel 28B. In the depicted embodiment of the first instrument 10 the height and the angle of bevel 28A remains substantially constant around the entire periphery of first instrument 10. Likewise, in the depicted embodiment the height and the angle of bevel 28B remains substantially constant around the entire periphery of first instrument 10. In alternative embodiments the height and/or the angle of bevels 28A and/or 28B may be variable along the periphery of the first instrument 10. In the depicted embodiment the entire periphery of the first instrument 10 may be utilized for treatment of soft tissue adhesion. Moreover, various contact or treatment surfaces having various curvatures, lengths, and bevel depths for various therapeutic benefits are provided along the periphery of the first instrument 10.

Optionally, one or more of the contact surfaces may be non-conforming to the contour of the soft tissue it is designed to engage. In other words, one or more contact surfaces may be similar to, but in non-conforming fit with (e.g., wider than, more curved than, less curved than) soft tissue that it is designed to engage, thereby increasing the actual level of engagement with the soft tissue and allowing the contact surface to be utilized on soft tissue area on patients having varying anatomies.

First instrument 10 also comprises a plurality of engraved ridges 30 spaced along each side of instrument 10 to provide an aid in gripping the instrument. In some embodiments the ridges 30 may be formed by engraving troughs into a substantially planar surface. Accordingly, in some embodiments the ridges 30 may be substantially planar with a surface of the instrument 10 that is provided peripherally of the ridges 30 and may be raised with respect to the engraved troughs therebetween. In some embodiments the troughs may be engraved to a depth of approximately 0.015 inches. In the depicted embodiment, the side of the first instrument 10 visible in FIG. 1A has ridges 30 proximal to first end 32 and second end 34, but no ridges in the middle thereof. In some embodiments ridges may be also be placed in the middle of the side of the first instrument 10 visible in FIGS. 1A and 1D. For example, in some embodiments text (e.g. identifying text) that forms ridges may be provided in the middle of the side of the third instrument 10 visible in FIGS. 1A and 1D. On the side of the first instrument 10 visible in FIGS. 1C and 1E the ridges 30 are provided substantially across the entire surface. In alternative embodiments the ridges 30 may be provided in an alternative layout to facilitate a desired arrangement for aid in gripping the first instrument 10. The plurality of ridges 30 may provide assistance in gripping first instrument 10 when any of the various contact surfaces is being utilized. For example, gripping surfaces 30 may provide assistance when any of contact surfaces proximal first end 32, second end 34, inner concave portion 22, and outer convex portion 24 are being utilized.

Referring now to FIGS. 2A-2E, a second instrument 100 in the system comprises a curvilinear continuous treatment edge 110 for manipulation and treatment of soft tissue adhesions. The edge 110 extends along the entire periphery of the second instrument 100. The edge 110 comprises a rounded first end 132 and a rounded second end 134. Both the first end 132 and the second end 134 may be utilized for the manipulation of soft tissue adhesions. The first end 132 is more pointed than the second end 134 and, as will be described in additional detail herein, has different beveled edge characteristics than the second end 134. Accordingly, the first end 132 provides therapeutic functionality unique from the therapeutic functionality of the second end 134.

The edge 110 also comprises a first curvilinear portion 112 and a second curvilinear portion 114. The first curvilinear portion 112 is generally concave and forms part of a circle having a radius. In some embodiments the radius may be approximately 1.67 inches. The edge 110 has two first twenty degree bevels 116A and 116B along the first curvilinear portion 112. Bevel 116B is of a larger height than bevel 116A in the depicted embodiment. The twenty degree bevels 116A and 116B may enable a more aggressive, deeper detection and treatment of soft tissue restrictions. As will be described in additional detail, interposed between bevel 116A and 116B is a bevel 128A, which extends at varying heights around the entire periphery of the second instrument 100. The bevel 128A is at approximately a forty-five degree angle and is of a substantially smaller height than bevels 116A and 116B along the length of first curvilinear portion 112.

The second curvilinear portion 114 includes a generally concave portion and a generally convex portion. The generally concave portion of the second curvilinear portion 114 may have a radius of approximately 3.5 inches in some embodiments and the generally convex portion of the second curvilinear portion 114 may have a radius of approximately 1.414 inches in some embodiments. The edge 110 has two first forty-five degree bevels 128A and 118B along the second curvilinear portion 114. The height of the bevel 118B is approximately fifteen percent of the height of the bevel 128A along the second curvilinear portion 114 in the depicted embodiment. The bevel 128A extends around the entire periphery of the second instrument 100 at varying heights, whereas the bevel 118B only extends along the second curvilinear portion 114.

The edge 110 also comprises a third curvilinear portion 122 and a fourth curvilinear portion 124. The third curvilinear portion 122 is generally opposite the first curvilinear portion 112 includes a generally concave portion and a generally convex portion. The generally concave portion of the third curvilinear portion 122 may have a radius of approximately 1.5 inches in some embodiments and the generally convex portion of the third curvilinear portion 122 may have a radius of approximately 2.0 inches in some embodiments. The edge 110 has two first forty-five degree bevels 128A and 128B along the third curvilinear portion 122. The height of the bevel 128B is approximately fifteen percent of the height of the bevel 128A along the third curvilinear portion 122 in the depicted embodiment. The bevel 128A extends at a varying height along the entire periphery of second instrument 100, whereas the bevel 128B only extends along the third curvilinear portion 122. The bevel 128B merges with bevel 126B on a first end and bevel 116B on an opposite end after extending around the second end 134.

The fourth curvilinear portion 124 is generally opposite the second curvilinear portion 114 of the edge 110. The fourth curvilinear portion 124 is generally concave and forms part of a circle having a radius. In some embodiments the radius may be approximately 2.01 inches. The edge 110 has two second twenty degree bevels 126A and 126B along the fourth curvilinear portion 124. The bevels 126A and 126B extend around the first end 132 of the instrument 100 until merging with respective of bevels 128A and 118B. At an opposite end of the bevels 126A and 126B they merge with respective of bevels 128A and 128B. Bevel 126B is of a larger height than bevel 126A in the depicted embodiment. The twenty degree bevels 126A and 126B may enable a more aggressive, deeper detection and treatment of soft tissue restrictions. As described in additional detail herein, interposed between bevel 126A and 126B is bevel 128A, which extends at a varying height around the entire periphery of the second instrument 100. The bevel 128A is at approximately a forty-five degree angle and is of a substantially smaller height than bevels 126A and 126*b* along the length of the fourth curvilinear portion 124.

In the depicted embodiment the entire periphery of the second instrument 100 may be utilized for manipulation of soft tissue adhesion. Moreover, various contact surfaces having various therapeutic benefits are provided along the periphery of the second instrument 100. The curvilinear surfaces of the second instrument 100 have various radii, bevels, and lengths to better facilitate contact with various soft tissue areas. The combination of the various bevel angles and the plurality of curvilinear surfaces permit treatment in several directions without necessitating changing hands. Moreover, the dual beveled edges enable a practitioner to move the instrument in multiple directions an may provide for better detection of soft tissue restrictions. Additionally, the combination of the various bevel angles and the plurality of curvilinear surfaces enable an increased likelihood of contact with three dimensional scar tissue in multiple planes. Optionally, one or more of the contact surfaces of second instrument 100 may be in non-conforming fit with soft tissue it is designed to engage.

A plurality of engraved ridges 140 are provided in each side of the second instrument 100 for contact with a therapist's fingers. The engraved ridges 140 may aid in gripping the second instrument 100 and may be formed by engraving troughs into a substantially planar surface. In the depicted embodiment, the side of the second instrument 100 visible in FIGS. 2A and 2D has ridges 140 proximal to first end 132 and second end 134, but no ridges in the middle thereof. In some embodiments ridges may be also be placed in the middle of the side of the third instrument 100 visible in FIGS. 2A and 2D. For example, in some embodiments text (e.g. identifying text) that forms ridges may be provided in the middle of the side of the third instrument 100 visible in FIGS. 2A and 2D. On the side of the second instrument 100 visible in FIGS. 2C and 2E the ridges 140 are provided substantially across the entire surface. In alternative embodiments the ridges 140 may be provided in an alternative layout to facilitate a desired arrangement for aid in gripping the second instrument 100. The ridges 140 may aid in gripping the second instrument 100 during utilization of the instrument 100 with any of the contact surfaces thereof.

FIGS. 3A-3E depict a third instrument 200 in the system comprising a curvilinear continuous treatment edge 210. Curvilinear edge 210 has a concave portion 212 that is designed for smaller body parts. In some embodiments concave portion 212 has a radius of approximately 0.75 inches. Curvilinear edge 210 also has a convex portion 214. In some embodiments convex portion 214 has a radius of approximately 6.55 inches. Interposed between the convex portion 214 and the concave portion 212 is an intermediary convex portion 213 that has a radius that is distinct from the radius of convex portion 214. In some embodiments the radius of intermediary convex portion 213 is approximately 0.5 inches. Curvilinear edge 220 has a convex portion 222 generally opposite concave portion 212, a concave portion 224 adjacent convex portion 214, and a second concave portion 226 interposed between concave portion 224 and first end 232.

The edge 210 has two first forty-five degree bevels 218A and 218B along a substantial majority of the length thereof. The height of the bevel 218B is approximately the same as the height of the bevel 218A in the depicted embodiment. The bevels 218A and 218B extend around the second end 234 of the third instrument 200. The first end 232 comprises a pick portion 240 which is designed to contact finer tissues such as those around the tendons of the hands and feet. The pick portion 240 has a first bevel 248A that is an approximately twenty degree bevel and a second bevel 248B that is an approximately twenty degree bevel. The twenty degree bevels 248A and 248B may enable a more aggressive, deeper detection and treatment of soft tissue restrictions. In some embodiments the pick portion 240 may be utilized in treatment of toes and/or fingers.

In the depicted embodiment the entire periphery of the third instrument 200 may be utilized for manipulation of soft tissue adhesion. Moreover, various contact surfaces having various therapeutic benefits are provided along the periphery of the third instrument 200. The curvilinear surfaces of the third instrument 200 have various curvatures, bevels, and lengths to better facilitate contact with various soft tissue areas. The combination of the various bevel angles and the plurality of curvilinear surfaces permit treatment in several directions without necessitating changing hands. Moreover, the dual beveled edges enable a practitioner to move the instrument in multiple directions an may provide for better detection of soft tissue restrictions. At least some portions of the third instrument 200 (e.g., pick portion 240) may be utilized for contact with superficial tendons around the hand, wrist, foot and/or ankle A plurality of engraved ridges 250 are provided in each side of instrument 200 for contact with a therapist's fingers. The engraved ridges 250 may aid in gripping the instrument 200 and may be formed by engraving troughs into a substantially planar surface. Optionally, one or more of the contact surfaces of third instrument 200 may be in non-conforming fit with soft tissue it is designed to engage.

Figure 3A:
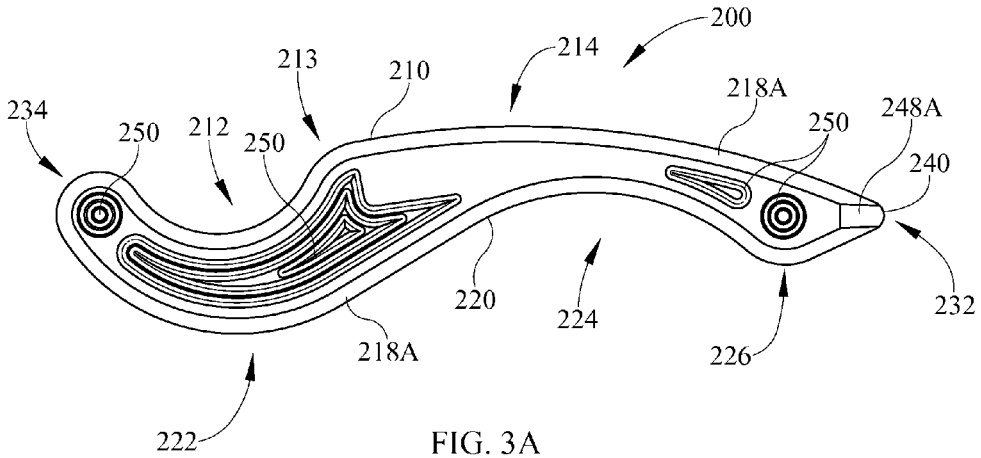
FIG. 3A is a side view of a first side of an instrument for manipulation of soft tissue adhesions in accordance with one embodiment of the present invention.
Figure 3B:
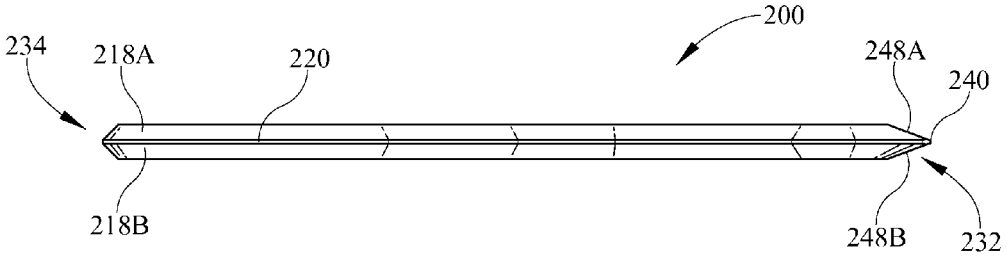
FIG. 3B is an elevation view of the instrument for manipulation of soft tissue adhesions of FIG. 3A.
Figure 3C:
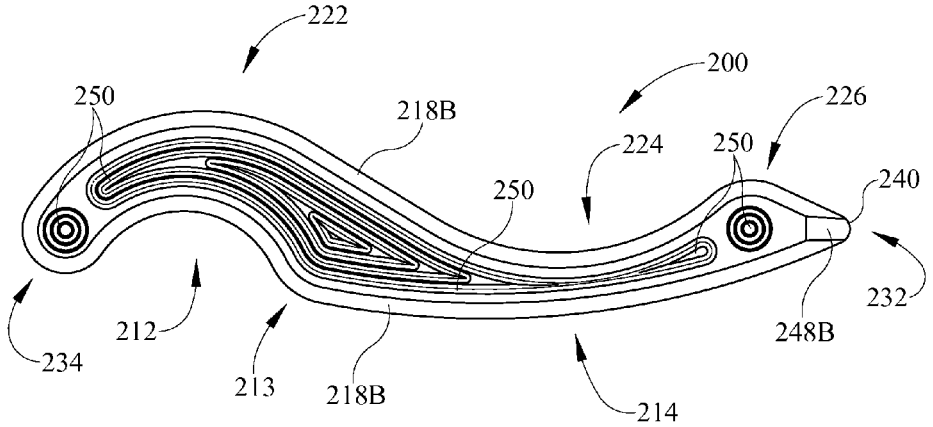
FIG. 3C is a side view of a second side of the instrument for manipulation of soft tissue adhesions of FIG. 3A.
Figure 3D:
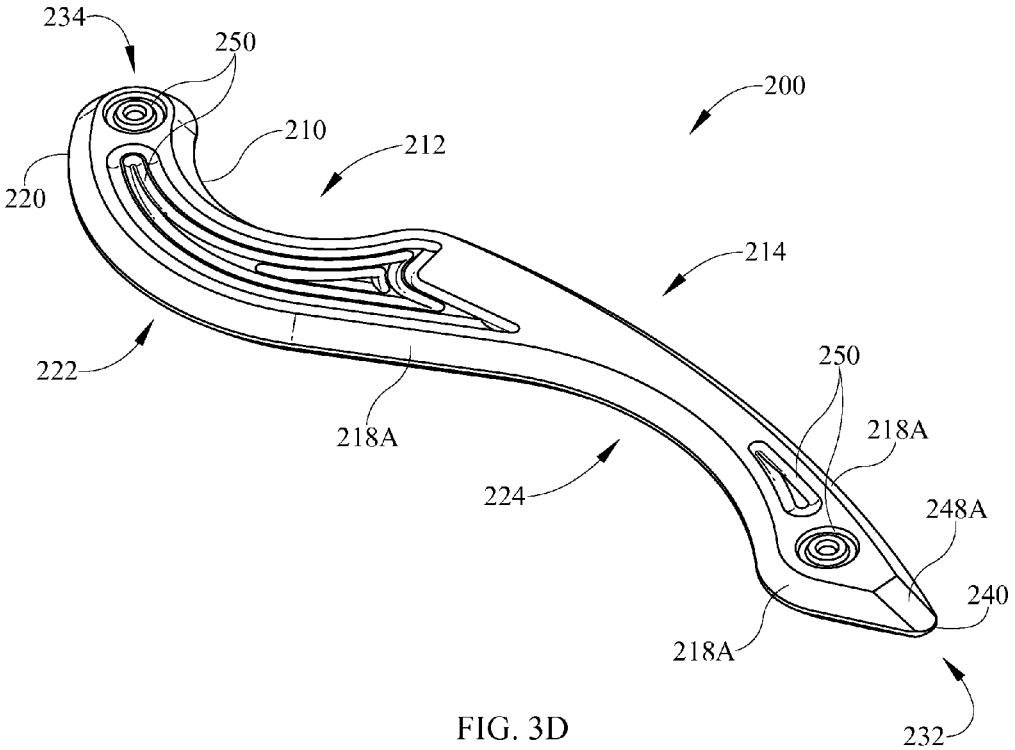
FIG. 3D is a front first side perspective view of the instrument for manipulation of soft tissue adhesions of FIG. 3A.
Figure 3E:
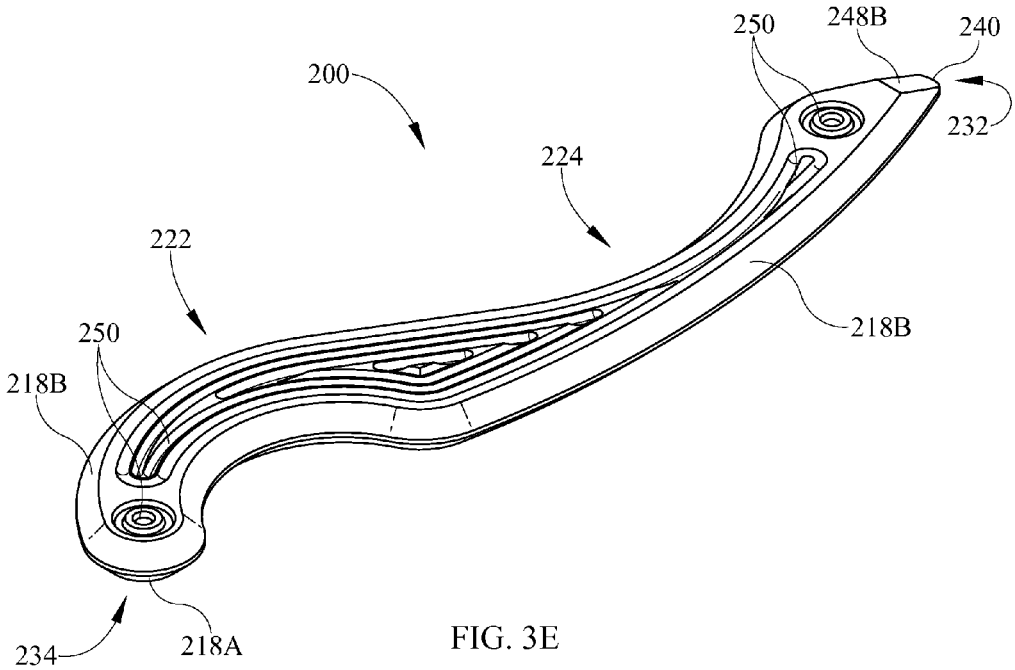
FIG. 3E is a front second side perspective view of the instrument for manipulation of soft tissue adhesions of FIG. 3A.

In the depicted embodiment, the side of the third instrument 200 visible in FIG. 3A has ridges 250 proximal to first end 232 and second end 234, but no ridges in the middle thereof. In some embodiments ridges may be also be placed in the middle of the side of the third instrument 200 visible in FIGS. 3A and 3D. For example, in some embodiments text (e.g. identifying text) that forms ridges may be provided in the middle of the side of the third instrument 200 visible in FIGS. 3A and 3D. On the side of the third instrument 200 visible in FIGS. 3C and 3E the ridges 240 are provided substantially across the entire surface. In alternative embodiments the ridges 250 may be provided in an alternative layout to facilitate a desired arrangement for aid in gripping the instrument. The ridges 250 may aid in gripping the third instrument 200 during utilization of the instrument 200 with any of the contact surfaces thereof.

In some embodiments the material construction of instruments 10, 100, and/or 200 may comprise stainless steel. In some versions of these embodiments the material construction may consist only of stainless steel and, optionally, 303 stainless steel. Use of instruments 10, 100, and 200 as a system for soft tissue manipulation may enable a level of soft tissue contact for scar tissue detection and treatment that typically at least four instruments. Accordingly, use of instruments 10, 100, and/or 200 as a system may enable a practitioner to maintain fewer soft tissue massage tools.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An instrument for the manipulation of soft tissue adhesions comprising:

a skin contacting member having a first end, a second end, a first side, a second side opposite said first side, and an edge extending along a periphery of said skin contacting member;

a plurality of engraved ridges for gripping said instrument provided proximal to said first end and second end of said skin contacting member, on first and second sides thereof;

said treatment edge having at least one inner curved portion, at least one outer curved portion, and opposed rounded ends, said opposed rounded ends connected to said inner curved portion and said outer curved portion;

wherein said edge is a treatment edge having first and second sides configured for treatment of soft tissue;

said treatment edge having a first bevel on the first side thereof-along said at least one outer curved portion and a second bevel along at least a portion of said outer curved portion of said treatment edge on a second side thereof, said first bevel extending toward said first side of said contacting member and said second bevel extending toward said second side of said contacting member;

wherein said first bevel along said at least one outer curved portion has at least one of a height and an angle that differs from a corresponding height and angle of said second bevel along said at least one outer curved portion;

wherein said inner curved portion and said outer curved portion have varying radii with respect to one another;

wherein said plurality of engraved ridges on said first end are spaced inwardly from said treatment edge and include opposed teardrop shaped ridges with concentric circular ridges there between; and wherein said plurality of engraved ridges on said second end are spaced inwardly from said treatment edge and include concentric circular ridges proximate said second end and generally oval ridges spaced therefrom along said treatment edge.

2. The instrument for the manipulation of soft tissue of claim 1 wherein said first bevel along said at least one outer curved portion has both a distinct height and a distinct angle from said height and angle of said second bevel along said at least one outer curved portion.

3. The instrument for the manipulation of soft tissue of claim 1 wherein an entirety of said edge is said treatment edge.

4. The instrument for the manipulation of soft tissue of claim 1 wherein at least one of said inner curved portion and said outer curved portion has a variable radius.

5. The instrument for the manipulation of soft tissue of claim 1 wherein said inner curved portion forms part of a first circle having a first radius and said outer curved portion forms part of a second circle having a second radius distinct from said first radius, said first circle having a first circle center point offset from a second circle center point of said second circle in at least two axis.

6. The instrument for the manipulation of soft tissue of claim 5 wherein said inner curved portion is concave and said outer curved portion is convex.

7. The instrument for the manipulation of soft tissue of claim 6 wherein said outer curved portion extends along at least the entire length of said inner curved portion.

8. The instrument for the manipulation of soft tissue of claim 1 further comprising a second inner curved portion connected to a single of said rounded ends and said inner curved portion.

9. The instrument for the manipulation of soft tissue of claim 8, wherein said second inner curved portion is concave and said inner curved portion is convex.

10. The instrument for the manipulation of soft tissue of claim 9, further comprising a second outer curved portion connected to a single of said rounded ends and said outer curved portion.

11. The instrument for the manipulation of soft tissue of claim 10, wherein said second outer curved portion is concave and said outer curved portion is convex.

12. An instrument for the manipulation of soft tissue adhesions comprising:

a skin contacting member having first and second ends and a continuous treatment edge provided along its periphery;

said continuous treatment edge configured for treatment of soft tissue and having at least one inner curved portion, at least one outer curved portion, and opposed ends connected to said inner curved portion and said outer curved portion;

a plurality of engraved ridges for gripping said instrument provided proximal to said first end and second end of said skin contacting member said first end having opposed teardrop shaped ridges with concentric circular ridges there between positioned proximate the treatment edge and said second end having concentric circular ridges proximate said second end and generally oval ridges spaced therefrom along said treatment edge; and said continuous treatment edge further having a first bevel and a second bevel each having varying angles along at least the same portion of said treatment edge on opposed sides thereof; said first bevel extending toward a first side of said contacting member and said second bevel extending toward a second side of said contacting member whereby an angle of manipulation of said tissue may be changed by changing sides of said contacting member.

13. The instrument for the manipulation of soft tissue adhesions of claim 12 wherein at least a portion of said first bevel has at least one of a distinct height and a distinct angle from a corresponding portion of said second bevel.

14. The instrument for the manipulation of soft tissue adhesions of claim 12 wherein said inner curved portion and said outer curved portion are tapered curve portions with respect to one another.

15. The instrument for the manipulation of soft tissue adhesions of claim 12 wherein said first side of said contacting member has a plurality of ridges thereon proximate each of said opposed ends.

16. The instrument for the manipulation of soft tissue adhesions of claim 15 wherein said second side of said contacting member has a second plurality of ridges thereon substantially across the entirety thereof.

17. The instrument for the manipulation of soft tissue adhesions of claim 15 wherein said ridges are substantially planar with surrounding portions of said first side.

18. The instrument for the manipulation of soft tissue adhesions of claim 15 wherein said second side of said contacting member has a second plurality of ridges thereon proximal each of said opposed ends.

19. The instrument for the manipulation of soft tissue of claim 12 wherein said first bevel and said second bevel are provided along the entirety of said treatment edge.

20. An instrument for the manipulation of soft tissue adhesions comprising:

a skin contacting member having a first side, a second side opposite said first side, and a treatment edge formed by the intersection of said first and second sides provided along a periphery of said skin contacting member, said first and second sides each having variable angled bevels along the same portion thereof;

said treatment edge having a plurality of unique contact surfaces, each of said unique contact surfaces configured to engage a unique portion of soft tissue;

wherein said first side of said contacting member has a plurality of ridges proximate each of said opposed ends;

wherein said second side of said contacting member has a plurality of ridges proximate each of said opposed ends;

wherein said ridges on said first side includes a pair of opposed teardrop shaped ridges having concentric circular ridges there between proximate a first end of said skin contacting member and concentric circular ridges proximate a second end of said skin contacting member and generally oval ridges spaced therefrom along said treatment edge; and:

wherein said ridges are spaced inwardly from and shaped like said treatment edge and are arranged to enable contact between at least some of said ridges and fingers of a therapist during engagement of any of said unique contact surfaces against said soft tissue.

21. An instrument for the manipulation of soft tissue adhesions comprising:

a skin contacting member having a first end, a second end, a first side, a second side opposite said first side, and a treatment edge provided along a periphery of said skin contacting member;

a plurality of engraved ridges for gripping said instrument provided proximal to said first end and second end of said skin contacting member, on first and second sides thereof;

said treatment edge having a first bevel and a second bevel along at least a portion of opposed sides of said treatment edge; said first bevel extending toward said first side of said contacting member and said second bevel extending toward said second side of said contacting member;

wherein along a first portion of said treatment edge said first bevel and said second bevel have a substantially common first angle;

wherein along a second portion of said treatment edge said first bevel has a second angle offset from said first angle at least ten degrees such that said first and second bevels differ along the second portion of said treatment edge; and said plurality of engraved ridges spaced inwardly from said treatment edge, said first end of said treatment edge having opposed teardrop shaped ridges with concentric circular ridges there between positioned proximate the treatment edge and said second end of said treatment edge having concentric circular ridges proximate said second end and generally oval ridges spaced therefrom along the second end of said treatment edge.

22. The instrument for the manipulation of soft tissue adhesions of claim 21 wherein said second angle is offset from said first angle at least twenty degrees.

23. The instrument for the manipulation of soft tissue adhesions of claim 21 wherein said second bevel is at least fifty percent of the height of said first bevel along said first portion.

24. The instrument for the manipulation of soft tissue adhesions of claim 21 wherein said second bevel is at least twenty-five percent of the height of said first bevel along said first portion.

25. The instrument for the manipulation of soft tissue adhesions of claim 21 wherein along said second portion of said treatment edge said second bevel has said second angle.

* * * * *